United States Patent [19]

Kosaka

[11] 4,173,857

[45] Nov. 13, 1979

[54] DOUBLE-LAYERED WOODEN ARCH TRUSS

[76] Inventor: Yoshiharu Kosaka, To-113-2, Aza konagano, Terai machi, Nomi gun, Ishikawa ken, Japan

[21] Appl. No.: 854,074

[22] Filed: Nov. 22, 1977

[51] Int. Cl.[2] ..... E04B 1/32

[52] U.S. Cl. ..... 52/642; 52/643; 52/644; 52/225

[58] Field of Search ..... 52/642, 644, 225, 226, 52/643, 639, 692, 693

[56] References Cited

U.S. PATENT DOCUMENTS

| | | | |
|---|---|---|---|
| 1,499,557 | 7/1924 | Shodin | 52/642 |
| 2,187,009 | 1/1940 | Beattie | 52/642 |
| 2,237,226 | 4/1941 | High | 52/643 X |
| 2,666,507 | 1/1954 | Ruark | 52/643 |
| 2,727,281 | 12/1955 | Cruciani | 52/642 |
| 3,019,861 | 2/1962 | Rasch et al. | 52/643 X |

*Primary Examiner*—Carl D. Friedman

*Attorney, Agent, or Firm*—Wenderoth, Lind & Ponack

[57] ABSTRACT

A double-layered wooden arch truss to be used for frameworks of wooden roofs and characterized in that the wooden arch truss is double-layered with an upper arch member formed of layered wooden plate material and a lower arch member formed identically to the upper member, the wooden arch truss being usable for cattle houses, etc.

1 Claim, 9 Drawing Figures

DOUBLE-LAYERED WOODEN ARCH TRUSS

FIELD AND PRIOR ART OF THE INVENTION

This invention relates to a double-layered wooden arch truss for frameworks of roofs of wooden structures.

Generally speaking, a conventional wooden arch truss has been constructed with its beam members and arch portions composed of square lumber members and wooden members or arch portions composed of a plurality of short members connected together so that the arch forming work is difficult and the arch truss, when used as a framework for use with roofs, is not strong enough for a vertical load as well as for horizontal load, and, furthermore, it has such drawbacks that the production cost becomes higher since square lumber members and wooden members are used for beam materials as they are. Also, an arch truss made of iron framework members is apt to be oxidized and has such disadvantages that it may easily be affected by excrements when used for cattle houses and the like so that under the present circumstances it is generally desired to use a wooden arch truss.

SUMMARY OF THE INVENTION

It is an object of the present invention to provide a double-membered wooden arch truss for frameworks of roofs said arch truss having upper and lower arch members composed of multi-layered wooden plate members.

It is also an object of the present invention to provide a double-membered wooden arch truss capable of being transported and assembled and of promoting the efficiency of field construction operations, reduction of working hours and wide-range reduction of construction costs.

Another object of the present invention is to provide a double-membered wooden arch truss constructed without use of a number of beam members of square lumber or wood and which is economical and durable.

Still another object of the present invention is to provide a double-membered wooden arch truss which can be used for strengthening, lightening and simplifying the roofing construction so as to make it solid and durable with respect to earthquake shocks, trembling under typhoons, etc. and which is also capable of distributing uniformly the vertical load due to the drifted snow and the roof structure, etc. and which furthermore has superior strength from the standpoint of structural dynamics.

Still another object of the present invention is to provide a double-membered wooden arch truss which is designed to make possible the efficient utilization of the interior of a building by providing a high ceiling by the use of a layered lower arch member.

Another object of the present invention is to provide a double-membered wooden arch truss in which a metal reinforcing rod is inserted through the layered upper and lower arch members and each of the connecting pillars so as to prevent the layered portions on the upper and lower arch members from peeling off and tightening both members while, at the same time avoiding corrosion of the metal reinforcing rod per se inserted through the connecting pillars and strengthening the inter-connection of the upper and lower arch members through the geometrical action of the metal reinforcing rod and the connecting pillars and their strength with respect to the load.

Another object of the present invention is to provide a double-membered wooden arch truss comprising a chord member stretching between the ends of one or both of the trusses for strengthening the arch by absorbing the vertical load or horizontal external force.

Still another object of the present invention is to provide a double-membered wooden arch truss, comprising an adjusting means for easily making the parts of the double-layered wooden arch truss parallel when assembling roofing frameworks so that the efficiency of mounting and assembling the arch truss is increased and the parallelization thereof can easily be effected at the construction site.

DETAILED DESCRIPTION OF THE INVENTION

Figure 1:
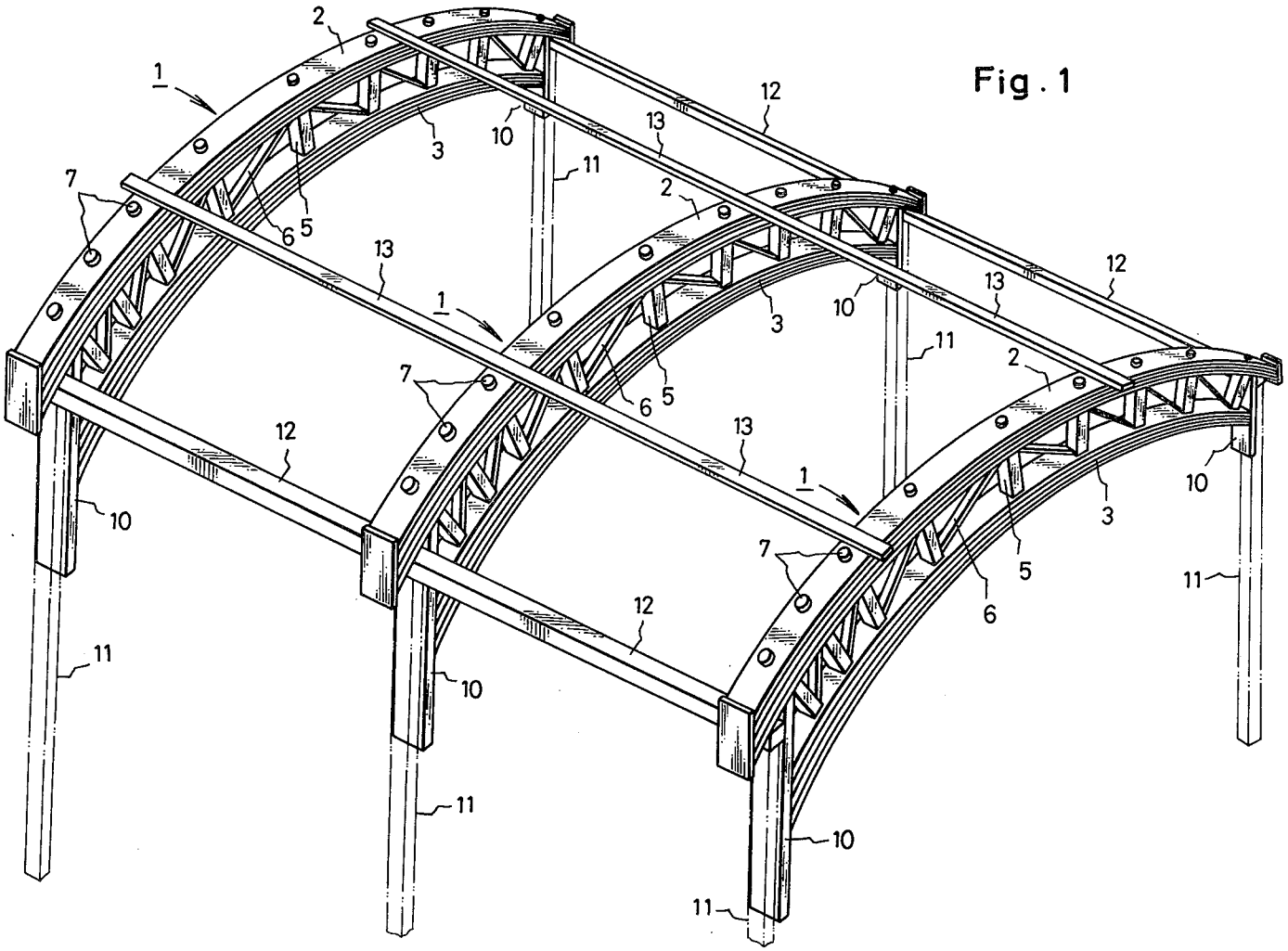
FIG. 1 is a perspective view showing the construction of a roofing framework using the double-membered wooden arch truss of the present invention.
Figure 2:
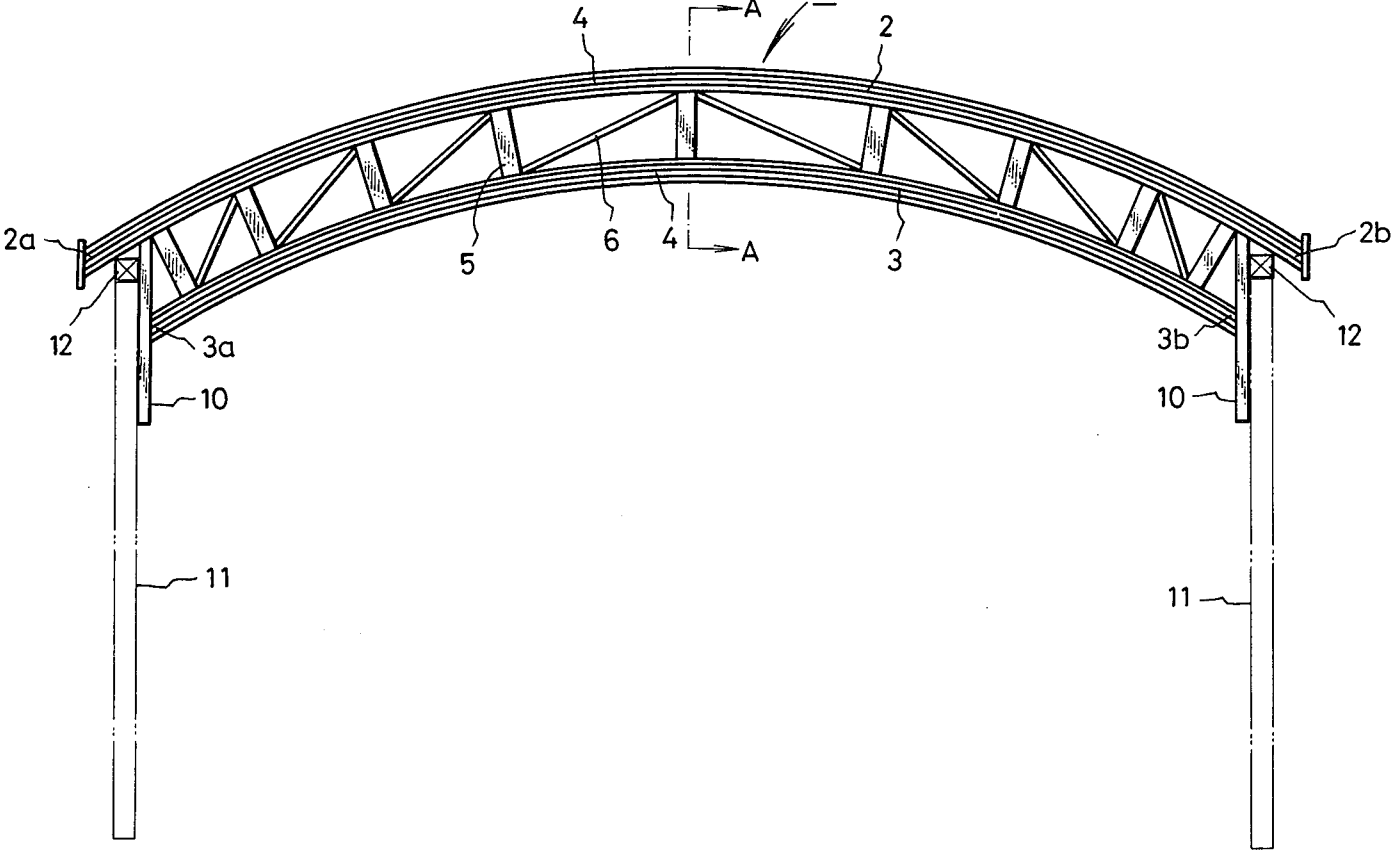
FIG. 2 is a front view of the double-membered wooden arch truss according to this invention.

The present invention will now be described in detail with reference to the accompanying drawings. In the drawings, 1 is double-membered wooden arch truss according to this invention, having an arch-like configuration. Double-membered wooden arch truss 1 comprises an upper and lower members 2 and 3 of arch material. Both arch members 2 and 3 are composed of a plurality of wooden plate members 4 bonded to each other with an adhesive or fastened to each other with nails from both sides to form the arch member. In this case, as shown in the exemplary embodiment, the number of wooden plate members the upper arch member 2 is greater than in the lower arch member 3, this being in consideration of the theory of structures. Also, the upper arch member 2 is longer than the lower arch member 3 in order to form the eaves of the building by the end portions **2*a* and 2*b***.

Between the upper arch truss material 2 and the lower layer 3 there is vertically disposed a plurality of substantially radial connecting pillars 5 the top end of each of pillars 5 being secured to the upper arch member 2 and the lower end thereof to the lower arch member 3. On a diagonal line between each of the adjacent connecting pillars 5 there is provided a reinforcing web member 6 which forms a triangle framework together with a relative connecting pillar 5 and a segmental side of the upper or lower arch member. Of course, there may be provided two web members 6 crossing on diagonal lines between adjacent connecting pillars 5.

Figure 5:
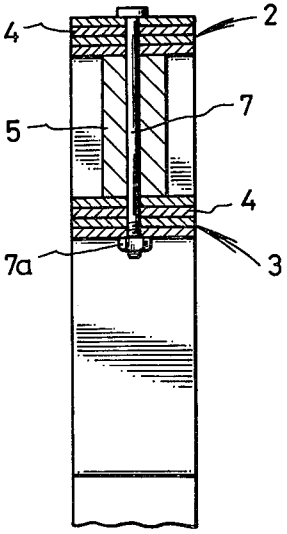
FIG. 5 is a sectional view thereof taken along the line B—B in FIG. 4.
Figure 3:
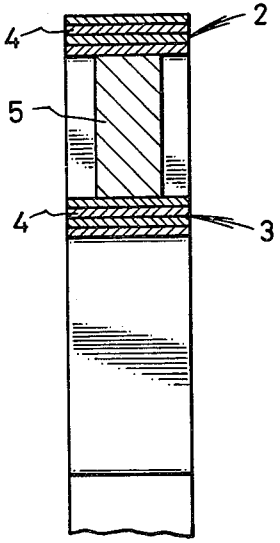
FIG. 3 is a sectional view taken along the line A—A in FIG. 2.
Figure 4:
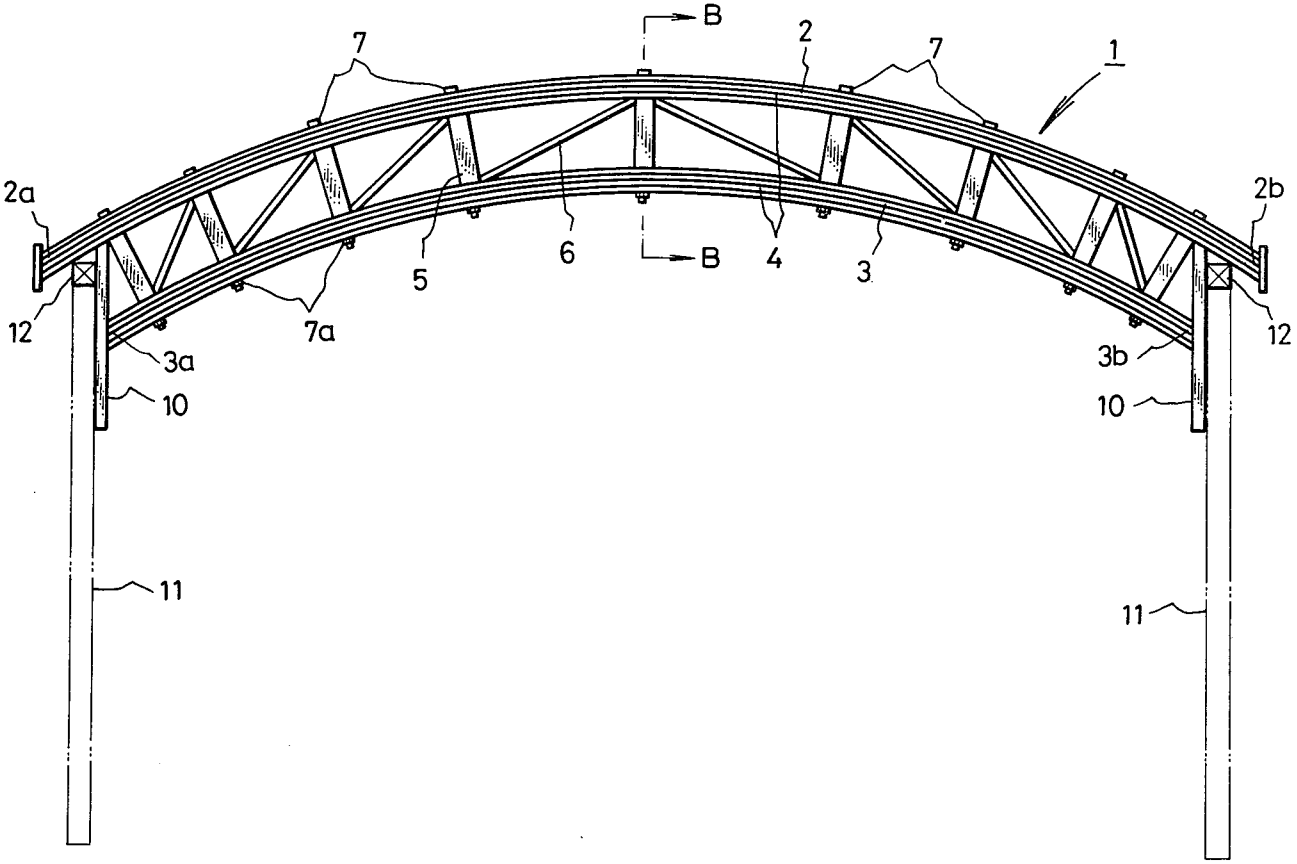
FIG. 4 is a front view of the double-membered wooden arch truss using metal reinforcing rods.
Figure 9:
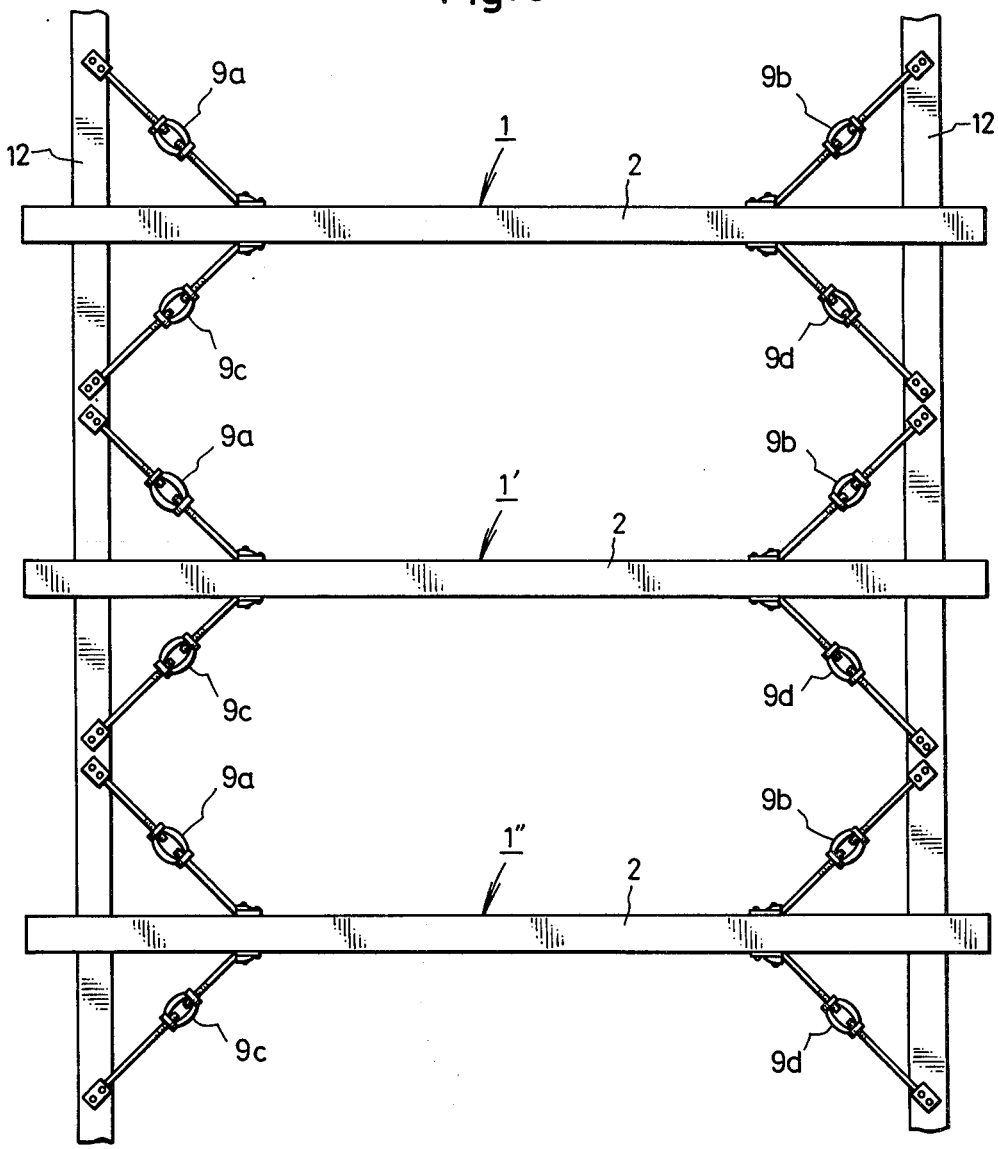
FIG. 9 is a plan view showing how to construct the roofing framework by arranging a plurality of the double-membered wooden arch trusses of the present invention in parallel.

In FIGS. 4 to 7 and also in FIG. 9, reference numeral 7 is a metal reinforcing rod which serves to strengthen the triangle framework described above and fasten the upper arch member 2 and the lower member 3 to each other. As shown in FIG. 5, metal reinforcing rod 7 is inserted through connecting pillars 5 from the top surface of the upper member 2 to the bottom surface of the lower member 3 and is fastened thereto with a lock nut 7*a*. It is optional to provide as many reinforcing rods as conecting pillars 5 or they may be provided in different numbers.

Figure 6:
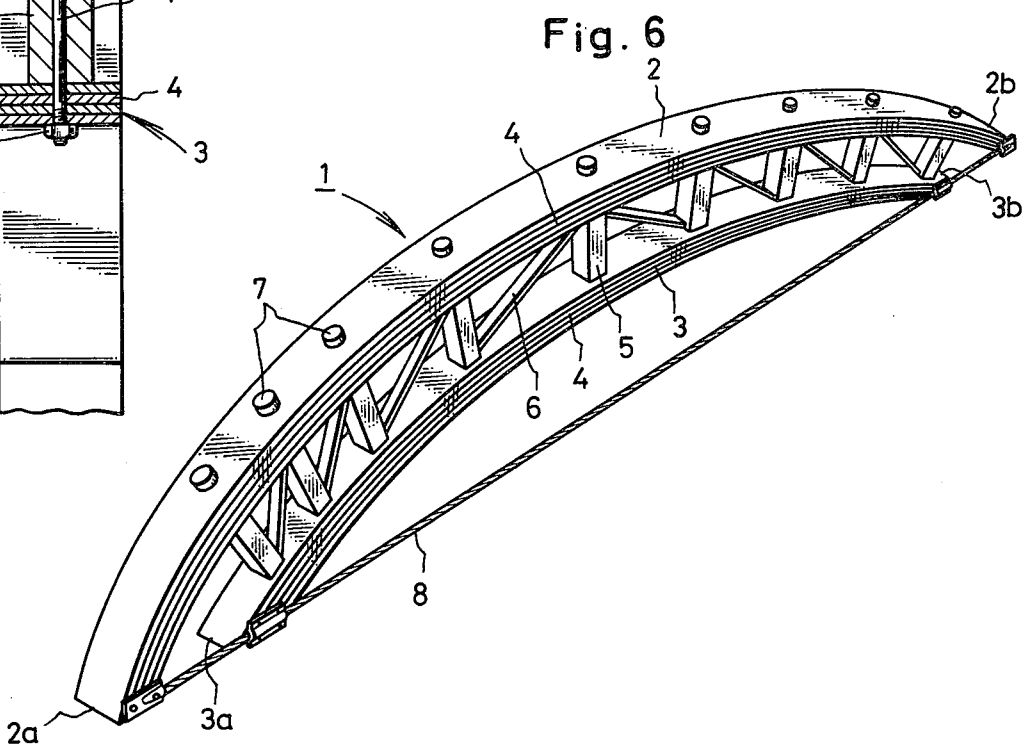
FIG. 6 is a perspective view of the double-membered wooden arch truss provided with a stretchable chord member.
Figure 7:
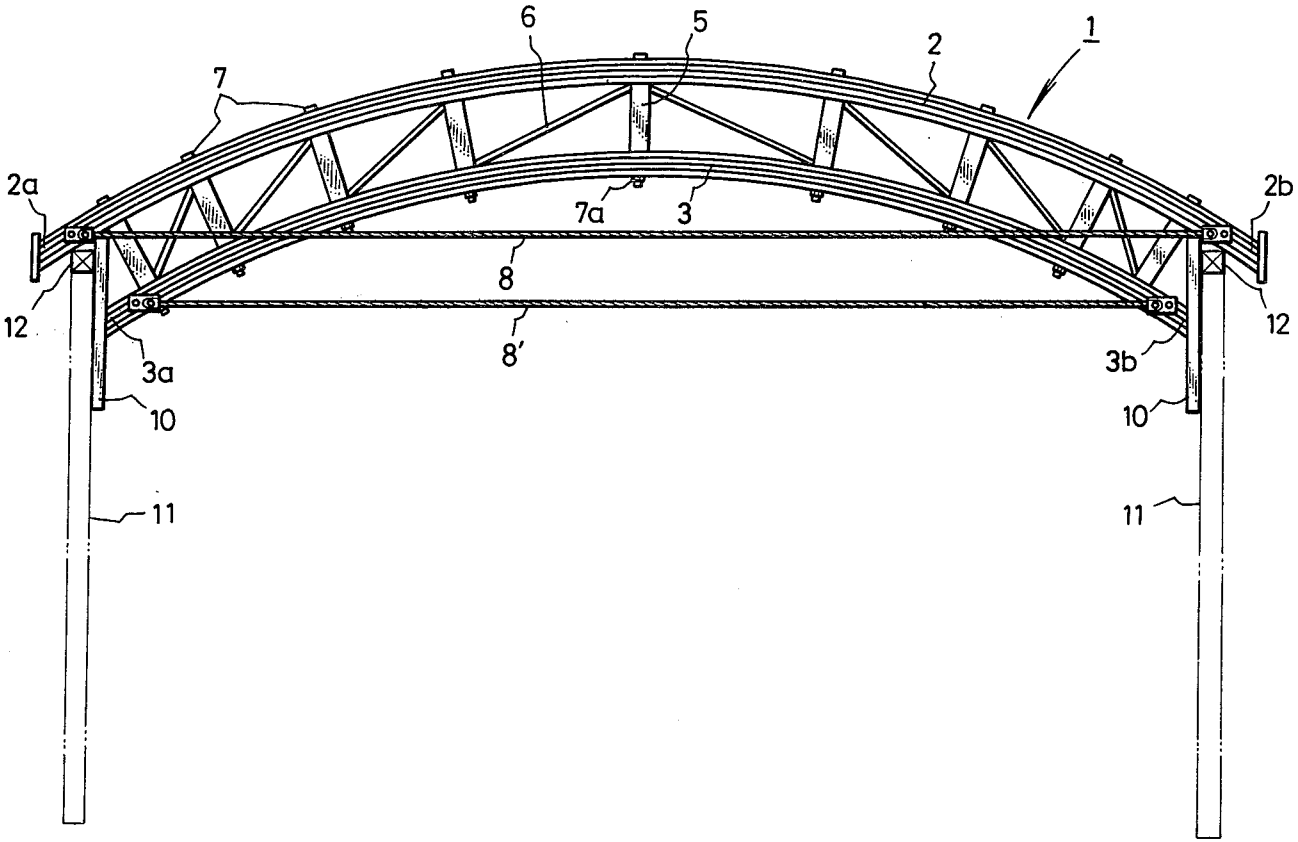
FIG. 7 is a front view of the double-membered wooden arch truss showing another embodiment of the stretchable chord member.

In FIGS. 6 and 7, the numeral 8 is a stretchable chord member made of wire or metal pipe or the like. As shown in FIG. 6, chord member 8 is stretched from each of the ends 2*a* and 3*a* of the upper and lower arm arch members 2 and 3 to the other ends 3*b* and 2*b* thereof so as to stengthen the construction of both members 2 and 3, absorbing at the same time the load falling on both arch members 2 and 3, said chord being stretched in line and common to both members 2 and 3. In this case, chord member 8 can be fastened only at both ends 2*a* and 2*b* of the upper member 2 or the chord member can be stretched by means of the reinforcing pillars to be discussed later. Although not shown in the drawings, a single chord member 8 can be stretched along the longitudinal central line of both members 2 and 3.

FIG. 7 shows one exemplary case in which both ends 2*a* and 2*b* of the upper member 2 are pulled toward each other by means of chord member 8 while the ends 3*a* and 3*b* of the lower member 3 are pulled toward each other by means of a second chord member 8' so as to provide the arch members with additional strength. It is pointed out that any kind of wire or rod having proper elasticity other than the above-described wire or pipe may be employed as material for forming chord member 8.

Figure 8:
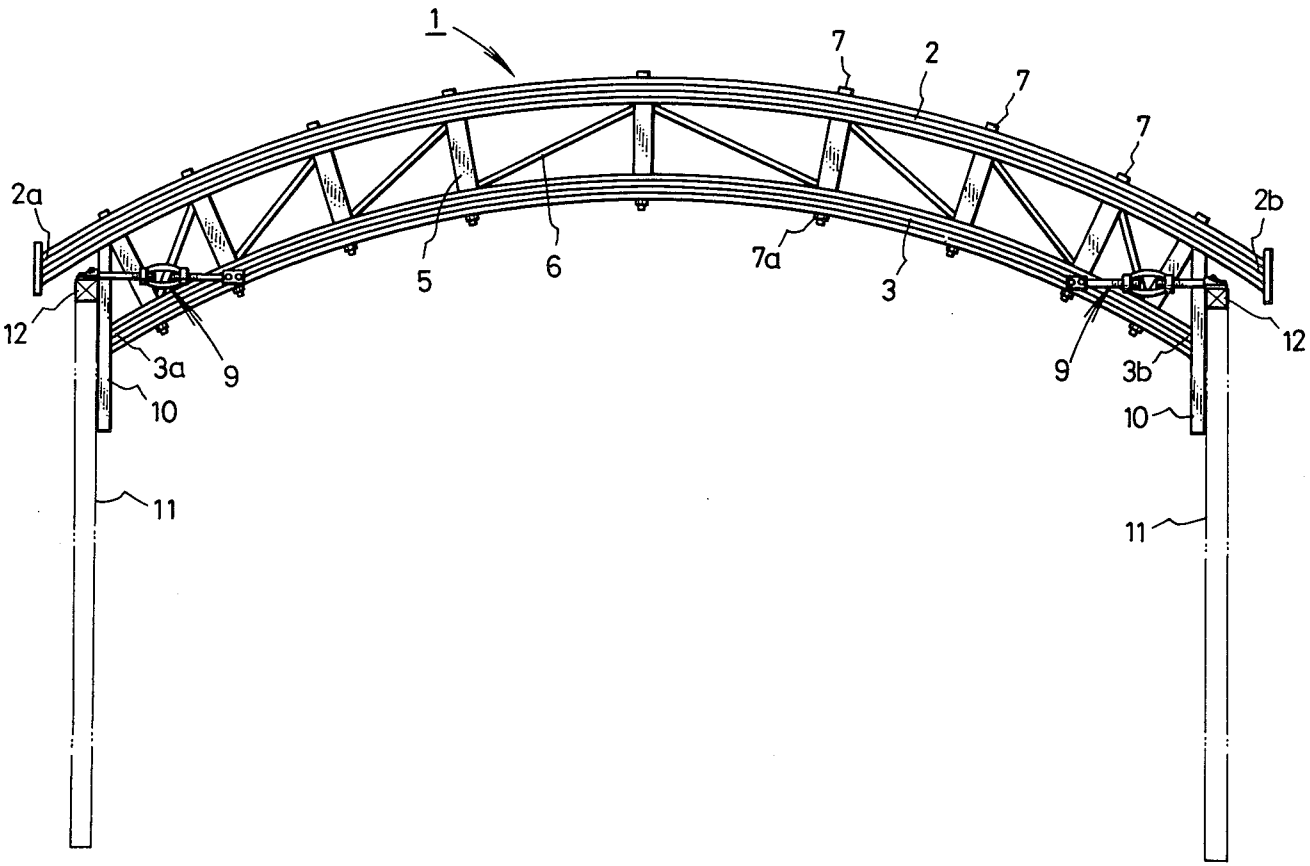
FIG. 8 is a front view of the double-membered wooden arch truss provided with turnbuckles.

In FIGS. 8 and 9, reference numeral 9 indicates adjustable length turnbuckles constituting angle ties. Turnbuckles 9 are secured at their one end to both left and right end portions of double-membered wooden arch truss 1, and at their other ends to pole plate 12 horizontally disposed on footing post 11, thus enabling the correction of the position of double-membered wooden arch truss 1. Turnbuckle 9 may be replaced with any other adjustable length; thus, it is not always necessary to use turnbuckles such as shown herein.

In the drawings, 10 is a reinforcing post to be used as means for the securing double-membered wooden arch truss to footing post 11. Reinforcing post 10 is firmly pre-secured to both ends 2*a*, 2*b*, 3*a* and 3*b* of the upper and lower arch truss members 2 and 3 and can be mounted with ease on footing post 11 in the field.

When carrying out the field assembling of the double-membered wooden arch truss of the described construction into a building structure, pole plate 12 is horizontally placed on footing post 11 of the structure after which a plurality of said double-membered wooden arch trusses 1 are arranged in parallel with a uniform spacing therebetween so as to directly cross the pole plate 12 and are fastened to each of the footing posts 11 and pole plates 12 to form a roofing framework. In this case, by using the double-membered wooden arch truss having reinforcing posts 10 fastened to its two ends it becomes easy to mount said double-membered wooden arch truss onto the footing posts 11 by locking said reinforcing posts 10 to the footing post 11 with a bolt and nut or with any other suitable means.

As shown in FIG. 9, the roofing framework is assembled and each of the double-membered wooden arch trusses 1, 1', 1'', etc. is adjusted therebetween so as to be parallel by means of turnbuckles 9*a*, 9*b*, 9*c* and 9*d* fastened to both ends on both sides of each of the arch trusses. The turnbuckles thus installed constitute angle ties for the wooden arch trusses. After the roofing framework has been constructed in such a manner as described above, roofing members formed of long iron plates and the like are laid in an arch over the top surface of the upper member 2 through the medium of rafters which completes the roofing construction.

This invention is thus capable of attaining the objects and effects set forth in detail at the beginning of the description by the construction described above.

What is claimed is:

1. A building structure comprising; a plurality of double-membered wooden arch trusses each having an upper arch member formed of laminated wood, a lower arch member formed of laminated wood and extending substantially parallel to said upper arch member and spaced therefrom, a plurality of substantially radially extending connecting pillars connected between said arch member and spaced along said arch member, a plurality of reinforcing web member connected between said upper and lower arch members and extending diagonally across the space between said connecting pillars, and a plurality of metal reinforcing rods, one extending directly through each of said connecting pillars and said upper and lower arch members and having fastening means on the ends thereof for fastening said arch members and pillars into an integral structure; said trusses being positioned at spaced parallel positions along the building structure; a plurality of supporting posts, one at each end of each truss; a plate member extending along the top of the posts at each end of the trusses and having the ends of the trusses supported thereon; and a plurality of turnbuckles, one connected between the lower arch member of each truss and the plate member for adjusting the position of the truss on the plate member and constituting angle ties for said trusses.

* * * * *